US005386612A

United States Patent [19]

Sham

[11] Patent Number: 5,386,612

[45] Date of Patent: Feb. 7, 1995

[54] PORTABLE STEAM VACUUM CLEANER

[76] Inventor: John C. K. Sham, Room 1508, Block C, 19 Broadwood Road, Hong Kong, Hong Kong

[21] Appl. No.: 52,147

[22] Filed: Apr. 23, 1993

Related U.S. Application Data

[63] Continuation-in-part of Ser. No. 942,308, Sep. 9, 1992.

[51] Int. Cl.[6] ..... A47L 7/00

[52] U.S. Cl. ..... 15/320; 15/344; 15/367; 15/401

[58] Field of Search ..... 15/321, 322, 401, 344, 15/320, 367

[56] References Cited

U.S. PATENT DOCUMENTS

| | | | |
|---|---|---|---|
| Re. 33,074 | 10/1989 | Levine . | |
| 1,803,693 | 5/1931 | Cutting | 15/320 |
| 2,497,674 | 2/1950 | Kolchinsky . | |
| 2,677,144 | 5/1954 | Parry . | |
| 2,770,826 | 11/1956 | Curfman . | |
| 2,832,086 | 4/1958 | Wells . | |
| 3,584,330 | 6/1971 | Wallin et al. | 15/401 X |
| 3,675,449 | 7/1972 | Bluestein . | |
| 4,327,459 | 5/1982 | Gilbert . | |
| 4,573,237 | 3/1986 | Kochte et al. . | |
| 4,583,260 | 4/1986 | Zai . | |
| 4,670,701 | 6/1987 | Sako et al. . | |
| 4,675,936 | 6/1987 | Rawlins . | |
| 4,686,735 | 8/1987 | Soeffker et al. . | |
| 4,776,058 | 10/1988 | Garner et al. . | |
| 4,788,738 | 12/1988 | Monson et al. . | |
| 4,798,613 | 1/1989 | Hetherington et al. . | |
| 4,821,366 | 4/1989 | Levine . | |
| 4,894,882 | 1/1990 | Toya . | |
| 4,896,396 | 1/1990 | Giannelli . | |
| 4,899,418 | 2/1990 | Steiner et al. . | |
| 4,920,608 | 5/1990 | Hult et al. . | |
| 4,924,548 | 5/1990 | Touya et al. . | |
| 4,930,178 | 6/1990 | Monson et al. . | |
| 4,955,104 | 9/1990 | Miller . | |
| 4,967,443 | 11/1990 | Krasznai et al. . | |
| 4,993,106 | 2/1991 | Hult et al. . | |
| 5,005,252 | 4/1991 | Steiner et al. . | |
| 5,020,187 | 6/1991 | Kosten et al. . | |
| 5,065,473 | 11/1991 | Krasznai et al. . | |
| 5,067,199 | 11/1991 | Alazet | 15/320 |
| 5,092,015 | 3/1992 | Kosten et al. . | |
| 5,099,545 | 3/1992 | Krasznai et al. . | |

FOREIGN PATENT DOCUMENTS

| | | | |
|---|---|---|---|
| 0200807 | 11/1986 | European Pat. Off. . | |
| 0269369 | 6/1988 | European Pat. Off. . | |
| 2232068 | 12/1990 | United Kingdom | 15/320 |

*Primary Examiner*—Chris K. Moore
*Attorney, Agent, or Firm*—Dilworth & Barrese

[57] ABSTRACT

A vacuum cleaning apparatus is provided which includes a housing having a handle portion and a nozzle portion. A reservoir is defined in the housing for retaining cleaning solution or water, and a heating unit is associated with the reservoir for heating the liquid so as to generate steam for delivery to a flat surface such as a window to be cleaned. A squeegee assembly is mounted to the housing adjacent the nozzle portion for wiping the window after liquid has been deposited thereon. A motor driven fan assembly is disposed within the housing in communication with the nozzle portion for drawing excess liquid and debris into the nozzle portion. The nozzle portion defines structure for separating and containing the liquid which is drawn into the apparatus.

24 Claims, 12 Drawing Sheets

PORTABLE STEAM VACUUM CLEANER

CROSS-REFERENCE TO RELATED APPLICATIONS

This application is a continuation-in-part of copending U.S. patent application Ser. No. 07/942,308 which was filed Sep. 9, 1992.

BACKGROUND OF THE INVENTION

1. Field of the Invention

This invention relates to portable vacuum cleaners, and more particularly to a portable vacuum cleaner adapted to generate steam to clean flat surfaces such as windows.

2. Description of Related Art

Portable vacuum cleaners for cleaning solid or liquid materials are well known in the art and are often referred to as "wet/dry" vacuum cleaners. Conventional wet/dry vacuum cleaners are disclosed for example, in U.S. Pat. No. 4,821,366 to Levine, U.S. Pat. No. 4,924,548 to Touya et al., and U.S. Pat. No. 5,005,252 to Steiner et al. These devices typically include a motor driven fan enclosed within a housing for producing a vacuum to draw liquid and debris into a collection nozzle. However, conventional wet/dry vacuums are unsuited for cleaning stained fabrics, upholstery, or carpets.

Improvements have been made in wet/dry vacuum cleaners in an effort to increase their stain cleaning effectiveness. For example, U.S. Pat. No. 4,788,738 to Monson et at. discloses a portable vacuum cleaner having an internal cleaning fluid supply system disposed in a removable discharge head which includes a chamber for retaining the cleaning fluid, a spray nozzle for discharging the cleaning fluid to the surface to be cleaned, and a vacuum intake head for drawing excess fluid and debris into the vacuum. A vacuum blower unit is provided in communication with the discharge head for creating suction to draw the excess cleaning fluid from the surface and for pumping cleaning fluid from the spray nozzle. A similar vacuum cleaner is described in U.S. Pat. No. 4,930,178 to Monson et al. which incorporates a filter element for separating debris from the cleaning fluid which enables the cleaning fluid to be recycled for subsequent use. Often, however, it may be undesirable to apply cleaning fluids directly to fabric, upholstery, or carpets, because fading, deterioration or other damage may result.

It is desirable therefore, to provide a portable vacuum cleaner which is capable of generating steam for delivery to an area to be cleaned, which overcomes the disadvantages of the prior an by providing for both steam cleaning and normal vacuuming.

Furthermore, it is often desirable to utilize a wet/dry vacuum to collect liquids such as spills or to collect liquids on flat surfaces such as floors, windows, tables, etc. A problem associated with prior art devices is the "pushing" of the liquid as the vacuum is advanced across the spill, requiring an excessive amount of strokes to pick up the liquid.

A portable steam cleaning device which is adapted for cleaning windows is described in U.S. Pat. No. 2,832,086 to Wells. This device includes a housing defining a steam generating chamber, a nozzle assembly for ejecting steam to a window surface to be cleaned, and a squeegee blade for wiping the window clean after steam has been applied thereto. However, this device does not provide a mechanism for removing and collecting liquid from the window after it has been wiped by the squeegee, and instead the liquid tends to collect on the window sill or floor and must be manually removed.

It is desirable therefore, to provide a vacuum cleaning device which is capable of generating steam for delivery to a flat surface such as a window, floor or table to be cleaned and which is capable of subsequently directing and collecting the liquid from the surface after it has been wiped clean.

SUMMARY OF THE INVENTION

The portable steam vacuum cleaner of the subject invention comprises a housing having a handle portion and a nozzle portion. A reservoir is provided in the housing for retaining water or a cleaning solution such as, for example, soapy water, and means are associated with the reservoir for heating the liquid so as to generate steam for delivery to an area to be cleaned.

In one embodiment of the invention, means are provided for pumping the liquid from the reservoir to the heating means. Alternatively, another embodiment of the invention provides conduit means for communicating the reservoir with the heating means and associated valve means for selectively transferring liquid from the reservoir to the heating means via the conduit means. Preferably, the heating means comprises a compact heating unit having a body portion which defines an entry port for receiving liquid from the reservoir, a plurality of cascading steam generating chambers in communication with the entry port for gradually heating the liquid flowing therethrough, and a plurality of exit ports in communication with one of the steam generating chambers for ejecting pressurized steam from the heating unit to an area to be cleaned.

A motor driven fan assembly is disposed within the housing of the vacuum cleaner and is in communication with the nozzle portion thereof for drawing excess liquid and debris into the nozzle portion. In addition, means are associated with the nozzle portion of the vacuum for containing the debris and excess liquid which is drawn into the nozzle portion by the motor driven fan assembly. Preferably, structure is defined within the nozzle portion for separating liquid from the air flow drawn into the vacuum.

In another embodiment of the subject invention, the portable steam vacuum cleaner is particularly adapted to clean flat surfaces such as windows and includes a squeegee assembly for wiping a window after steam has been delivered thereto and directing the condensed liquid towards the nozzle portion of the vacuum cleaner for collection. The squeegee assembly is preferably removably mounted to the housing of the vacuum cleaner adjacent the nozzle portion thereof and includes a replaceable squeegee blade. In operation, steam is generated within the housing, and is delivered to the surface to be cleaned, such as a window. The window is then wiped with the squeegee blade, and the excess liquid is drawn into the nozzle portion of the housing where it is subsequently contained. The device may also be utilized to contain and direct large spills to the vacuum port by guiding the liquid with the squeegee blade as the vacuum collects the liquid.

Further features of the invention, its nature, and various advantages will become more apparent to one skilled in the art to which the subject invention appertains from the following detailed description of the invention taken in conjunction with the accompanying drawings.

BRIEF DESCRIPTION OF THE DRAWINGS

Preferred embodiments of the subject invention will be described hereinbelow with reference to the drawings wherein.

DETAILED DESCRIPTION OF THE PREFERRED EMBODIMENTS

Figure 1:
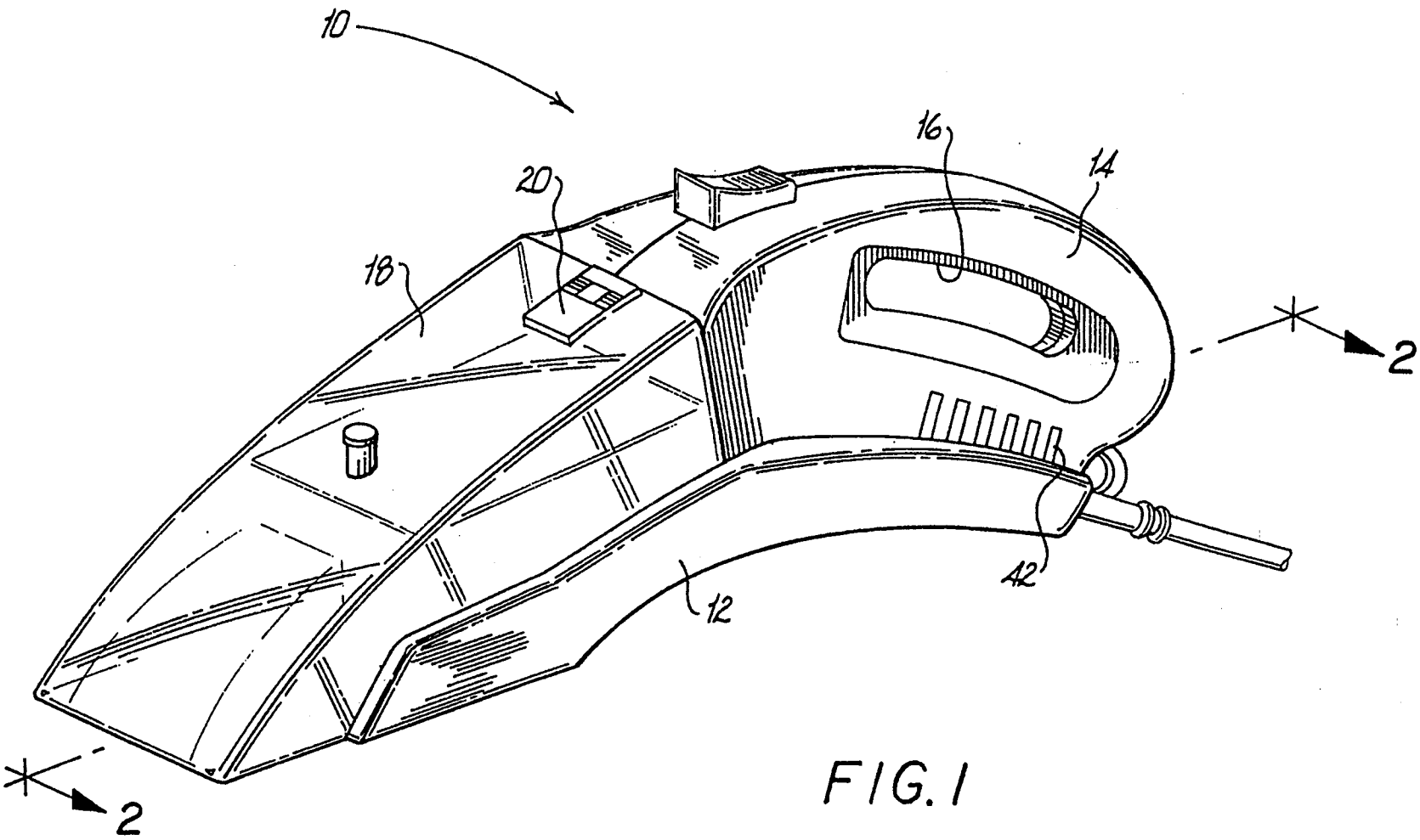
FIG. 1 is a perspective view of a portable steam vacuum cleaner in accordance with a preferred embodiment of the subject invention.

Referring now in detail to the drawings in which like reference numerals identify similar or identical elements, a preferred embodiment of the portable steam vacuum cleaner of the subject invention is illustrated in FIG. 1, and is designated generally by reference numeral 10. Vacuum cleaner 10 basically comprises a housing 12 which includes a handle portion 14 defining a handle grip 16, and a nozzle portion 18 preferably detachably mounted adjacent housing 12. Nozzle portion 18 may be released from housing 12 by movement of a clamp member 20 which may be manipulated by a user for gaining access to the interior of the vacuum cleaner 10.

Figure 2:
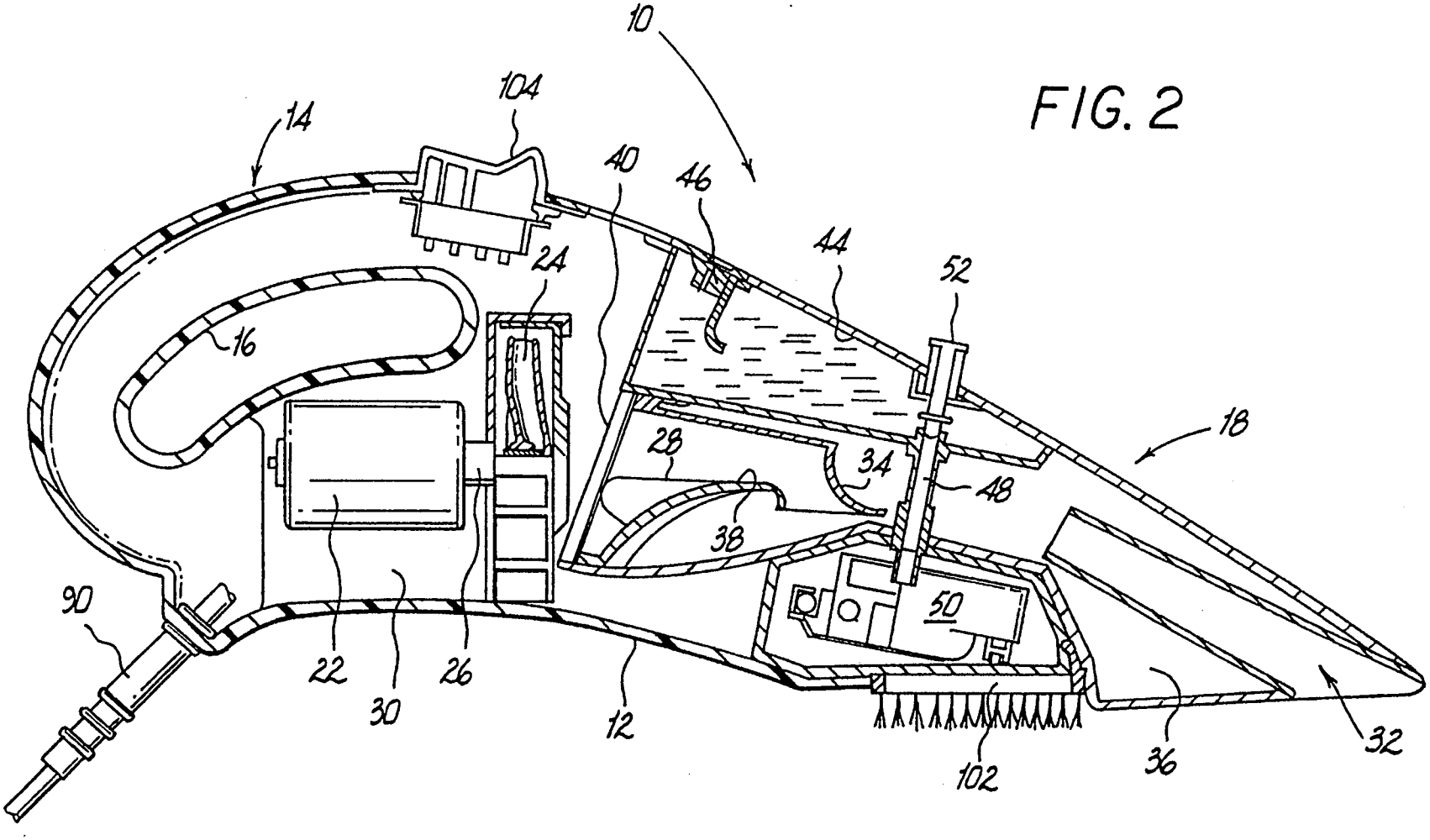
FIG. 2 is a side cross-sectional view taken along line 2—2 of FIG. 1.
Figure 3:
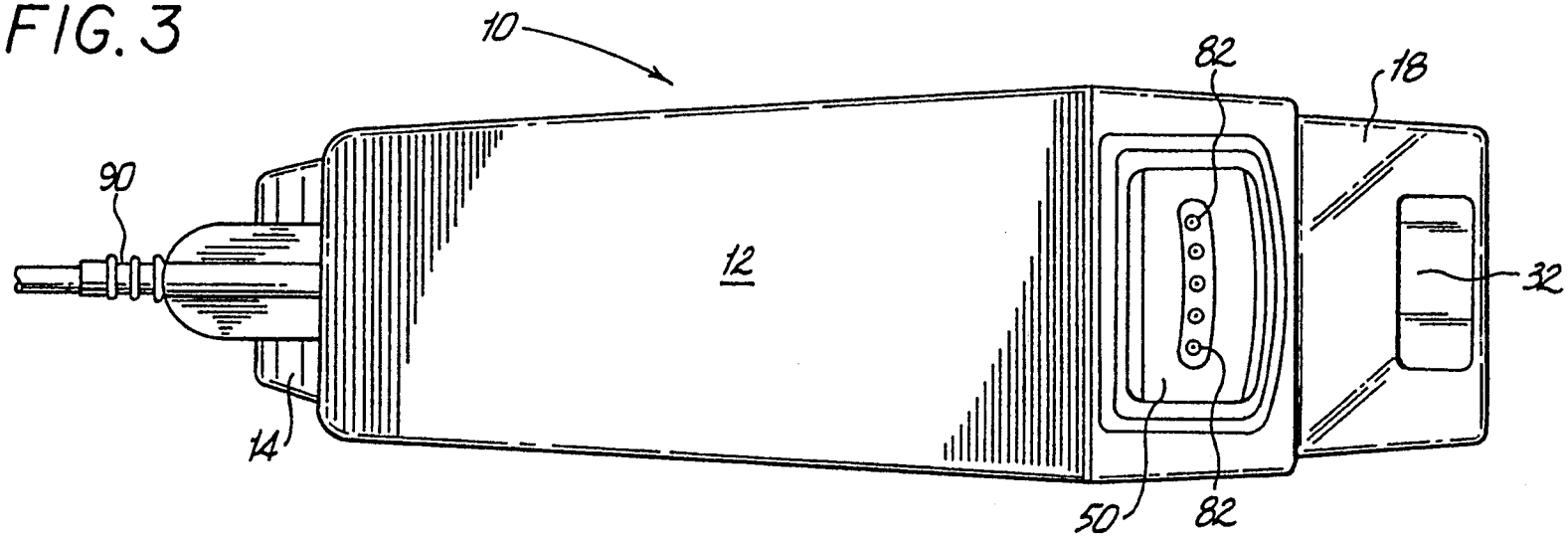
FIG. 3 is a bottom plan view of the portable steam vacuum cleaner of FIG. 1.
Figure 4:
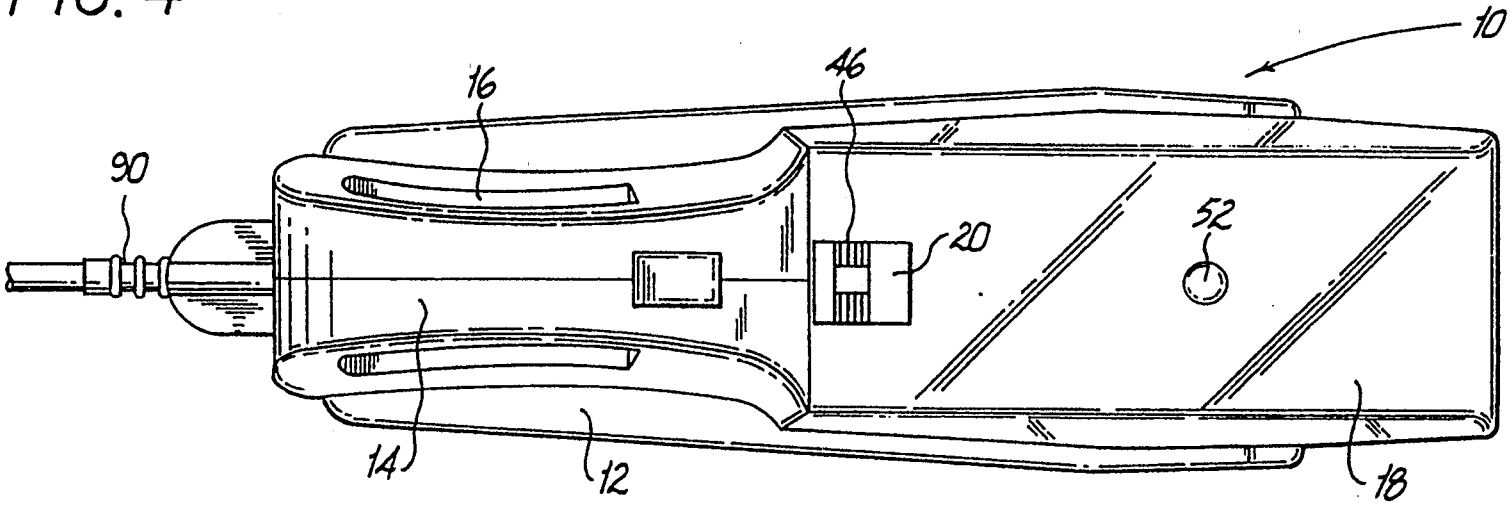
FIG. 4 is a top plan view of the portable steam vacuum cleaner of FIG. 1.
Figure 5:
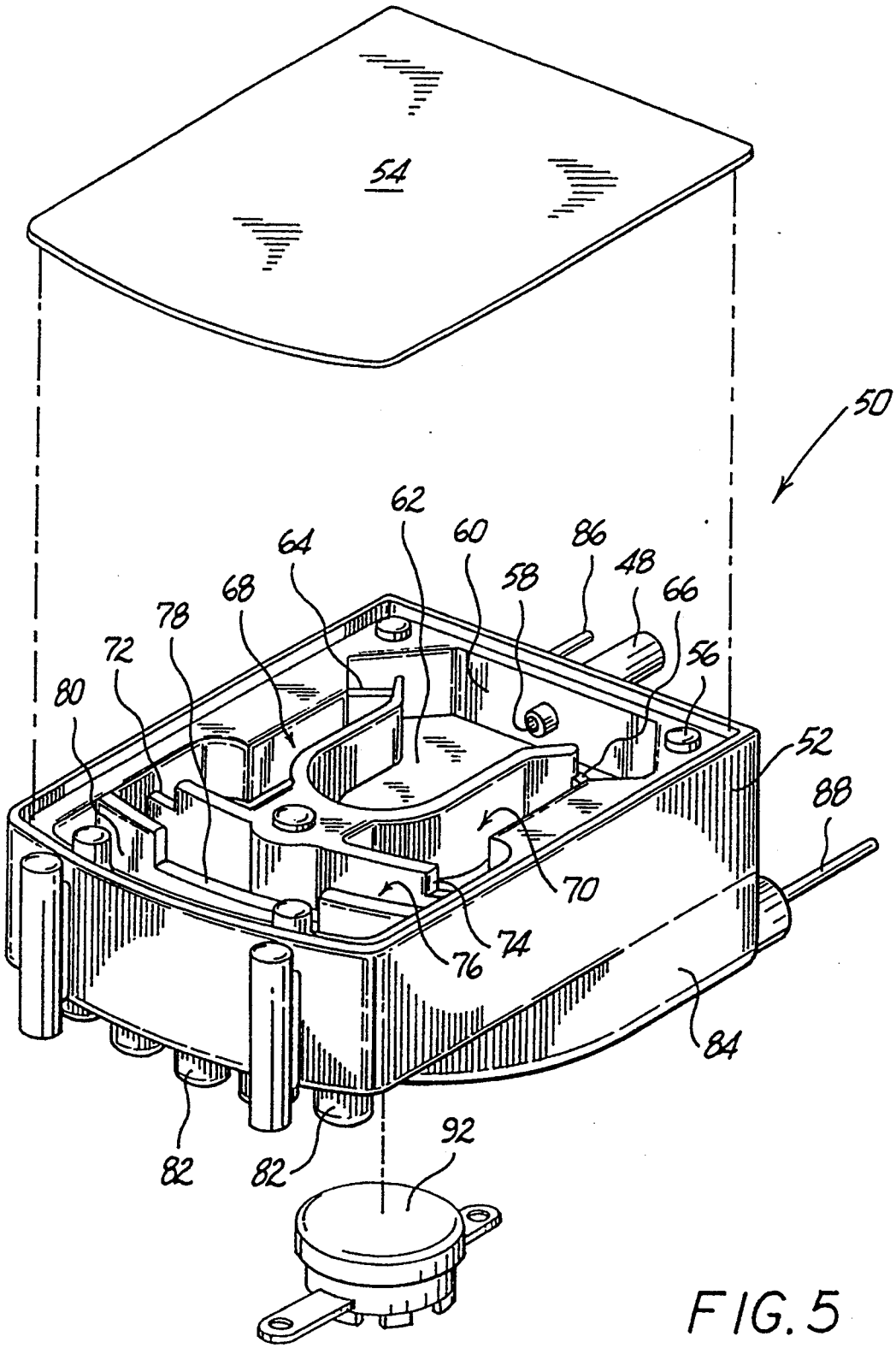
FIG. 5 is a perspective view of the heating unit for generating steam within the portable vacuum cleaner of FIG. 1.
Figure 7:
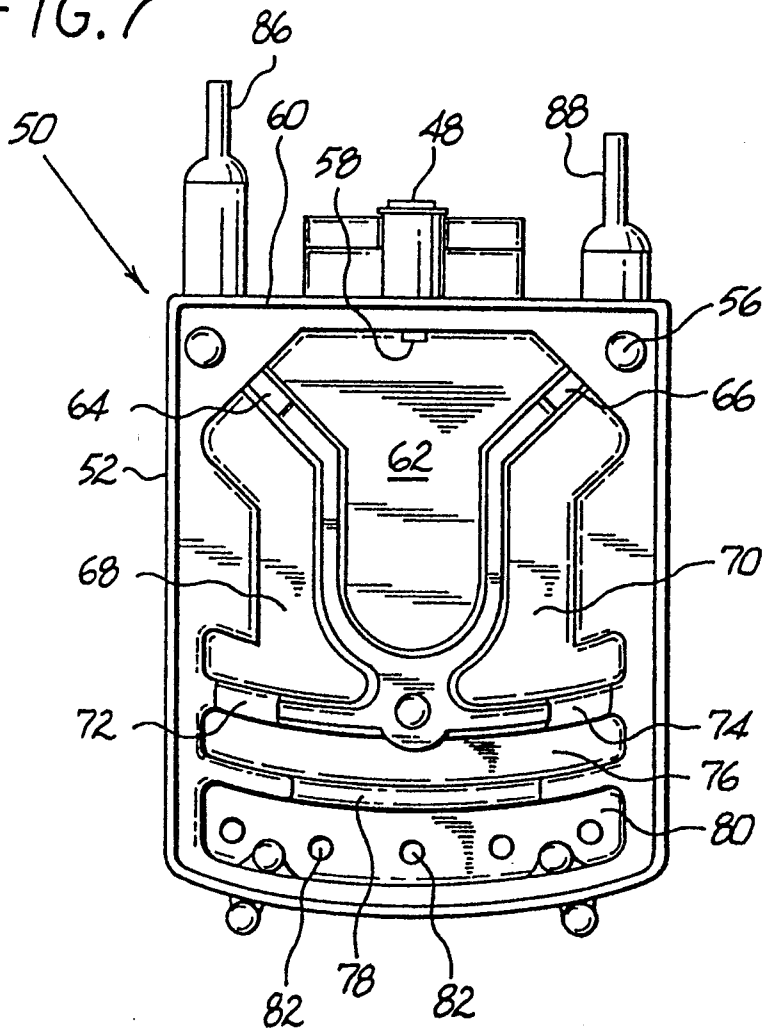
FIG. 7 is a top plan view of the heating unit of FIG. 5.

Referring to FIG. 2, a motor 22 is enclosed within housing 12 for driving a fan 24 mounted for rotation relative to motor 22. Rotation of fan 24 creates suction for drawing debris and liquids into the nozzle portion 18 of vacuum cleaner 10. A sealing member 26 is disposed between fan 24 and motor 22 for preventing liquid from contacting the motor 22 during wet vacuuming. In addition, a liquid separator 28 is defined in nozzle portion 18 which includes structure for preventing liquid drawn into nozzle portion 18 during wet vacuuming from entering the cavity 30 in which the motor 22 and fan 24 are located, while prohibiting debris from contacting fan 24 during dry vacuuming. In particular, water drawn into an uptake port 32 of nozzle portion 18 will be directed towards a diverting wall 34 of arcuate configuration which diverts the liquid into a containing area 36 formed in nozzle portion 18, while permitting air to be directed into a filter chamber 38 in which a filter element 40 is disposed for removing debris from the air flow. Air, drawn through filter element 40, is subsequently exhausted through a plurality of vents 42 which are formed in the lateral walls of housing 12 (see FIG. 1).

A reservoir chamber 44 is formed in the nozzle portion 18 of vacuum cleaner 10 for retaining water or a cleaning solution. Reservoir chamber 44 may be filled with the liquid in a conventional manner such as through an aperture 46 provided in clamp structure 20. A conduit 48 extends through a valve 52 from reservoir chamber 44 to a heating unit 50 which is provided for generating steam for delivery to an area to be cleaned. Conduit 48 permits gravitational flow of liquid from the reservoir 44 to the heating unit 50. Control valve 52 is associated with conduit 48 for selectively controlling the flow of liquid from the reservoir 44 to the heating unit 50.

Turning to FIGS. 5—9, the heating unit 50 comprises a body portion 52 of substantially rectangular configuration having a cover panel 54 mountable to body portion 52 at a plurality of standoff locations 56 disposed in spaced relation about the periphery of body portion 52. Preferably, heating unit 50 is constructed of cast aluminum or a like material. An entrance port 58 extends through a side wall 60 of body portion 52 through which liquid from reservoir chamber 44 flows via conduit 48. Entrance port 58 communicates with a plurality of cascading steam generating chambers defined in body portion 52 including a primary steam generating chamber 62 of a generally inverted Ω-shaped configuration. Opposed lateral dams 64 and 66 are formed at the head of primary steam generating chamber 62 for limiting the flow of heated liquid from the primary steam generating chamber 62 to a pair of secondary lateral steam generating chambers 68 and 70 of generally J-shaped configuration. Secondary dams 72 and 74 are formed at the trailing ends of lateral steam generating chambers 68 and 70 respectively, for limiting the flow of liquid into a tertiary steam generating chamber 76. A tertiary dam 78 separates the tertiary steam generating chamber 76 from a steam ejection chamber 80 which has a plurality of exit ports 82 defined therein through which steam generated by heating unit 50 is delivered to an area to be cleaned. A heating element such as cal-rod heating tube 84 is provided and is preferably cast integral with body portion 52 for transferring heat to the cascading steam generating chambers. Cal-rod heating tube 84 includes terminals 86 and 88 which are in electrical connection with a power supply source of alternating current from power cord 90.

Figure 6:
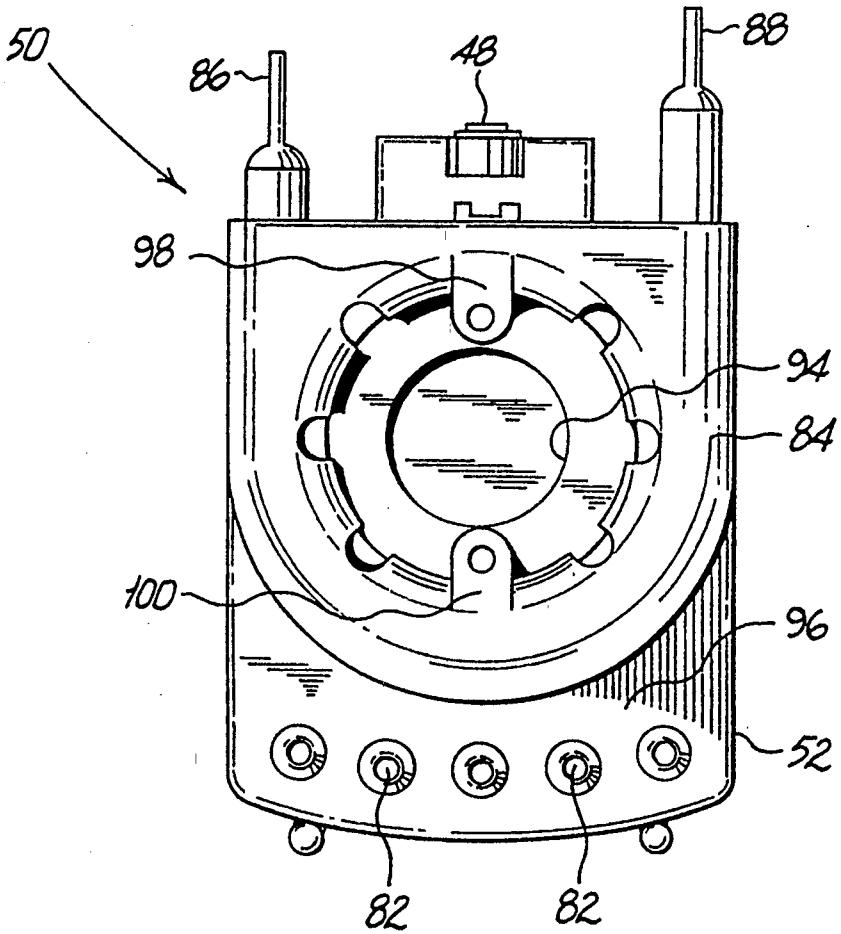
FIG. 6 is a bottom plan view of the heating unit of FIG. 5.
Figure 8:
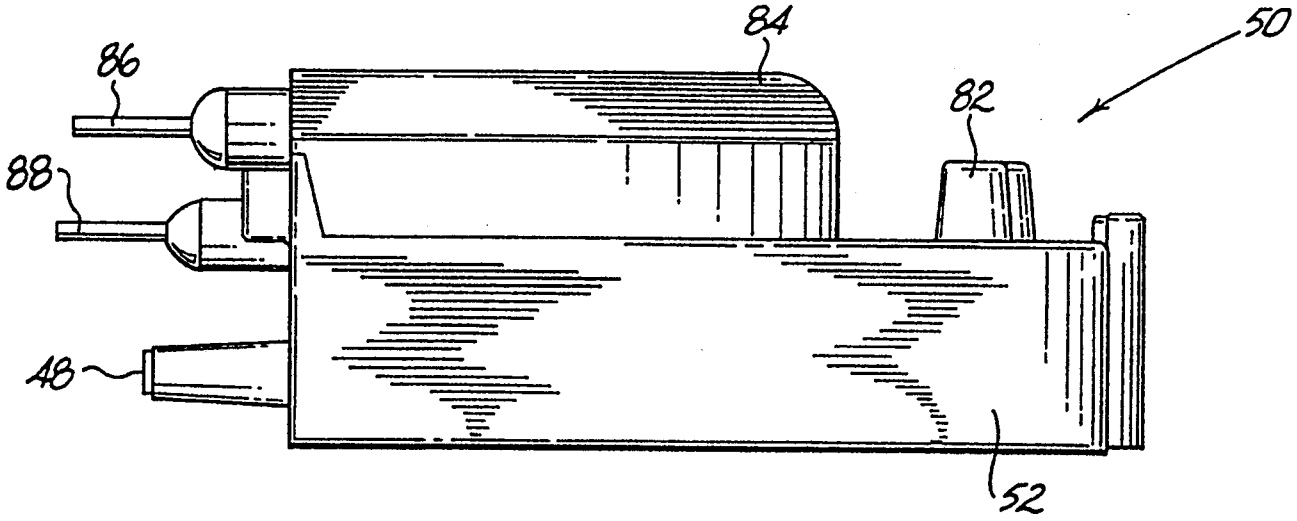
FIG. 8 is a side elevational view of the heating unit of FIG. 5.
Figure 9:
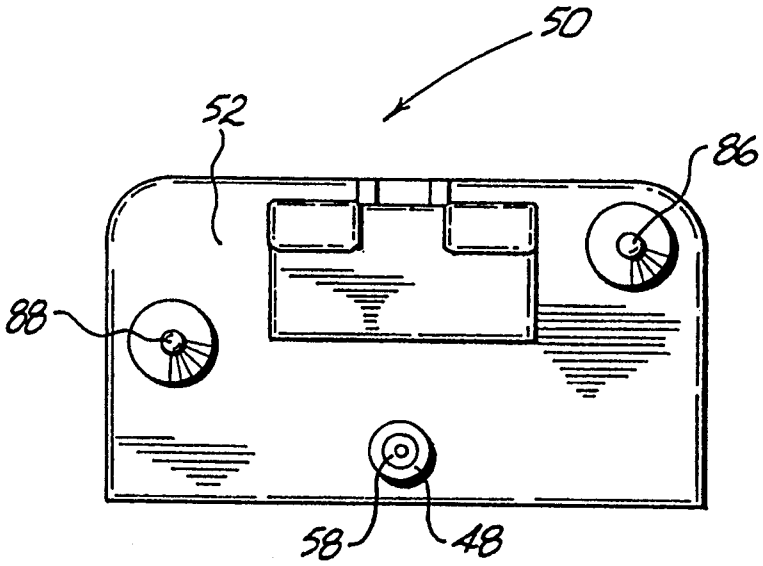
FIG. 9 is a front elevational view of the heating unit of FIG. 5.

A bimetallic thermostat 92 is mountable within an annular cavity 94 provided in the bottom surface 96 of the body portion 52 of the heating unit 50 by a pair of opposed mounting flanges 98 and 100 (see FIG. 6). The thermostat automatically controls the operation of heating unit 50. Referring to FIG. 2, a scrubbing brush 102 is detachably mounted to the housing 12 of vacuum cleaner 10 adjacent exit ports 82 of heating unit 50 for assisting cleaning operations.

In operation, the portable steam vacuum cleaner 10 of the subject invention may be prepared for use by connecting the unit to an electrical outlet through power cord 90. After approximately one minute, the cal-rod heating tube 84 will have transferred sufficient heat to the body portion 52 of heating unit 50 so as to generate steam once liquid is introduced. Thus, at a desired time, the user may depress control valve 52 to cause cleaning solution or water to gravitate from the reservoir 44 into the primary steam generating chamber 62 of heating unit 50 via conduit 48. Upon entering the primary steam generating chamber 62, the liquid will begin to increase in temperature and pressure whereby heated liquid will transfer into the secondary lateral steam generating chambers 68 and 70 by traversing lateral dams 64 and 66. The temperature and pressure of the liquid is further increased in steam generating chambers 68 and 70 until such time as it flows into the tertiary steam generating chamber 76 by passing over secondary dams 72 and 74. Once introduced into the tertiary chamber 76 of heating unit 50, the temperature of the liquid is sufficiently increased to generate steam which traverses tertiary dam 78 and enters into the ejection chamber 80 where it is ejected under pressure through the ejection ports 82 to the area to be cleaned. As steam is ejected from the heating unit 50, the user may manipulate the device to employ scrub brush 102 which will assist in the cleaning task.

Once the stain has been removed and the area cleaned, the user may depress a toggle switch 104 located adjacent handle 16 which activates the motor driven fan 24, thereby creating a vacuum for drawing debris and the excess liquid created by the condensed steam into the uptake port 32 of nozzle portion 18. Liquid drawn into uptake portion 32 is advantageously directed toward the diverting wall 34 of separator structure 28 and into the liquid containing area 36, while air flow is directed through filter chamber 38, against filter element 40, and subsequently through the exhaust vents 42 formed in the wall of housing 12.

Figure 10:
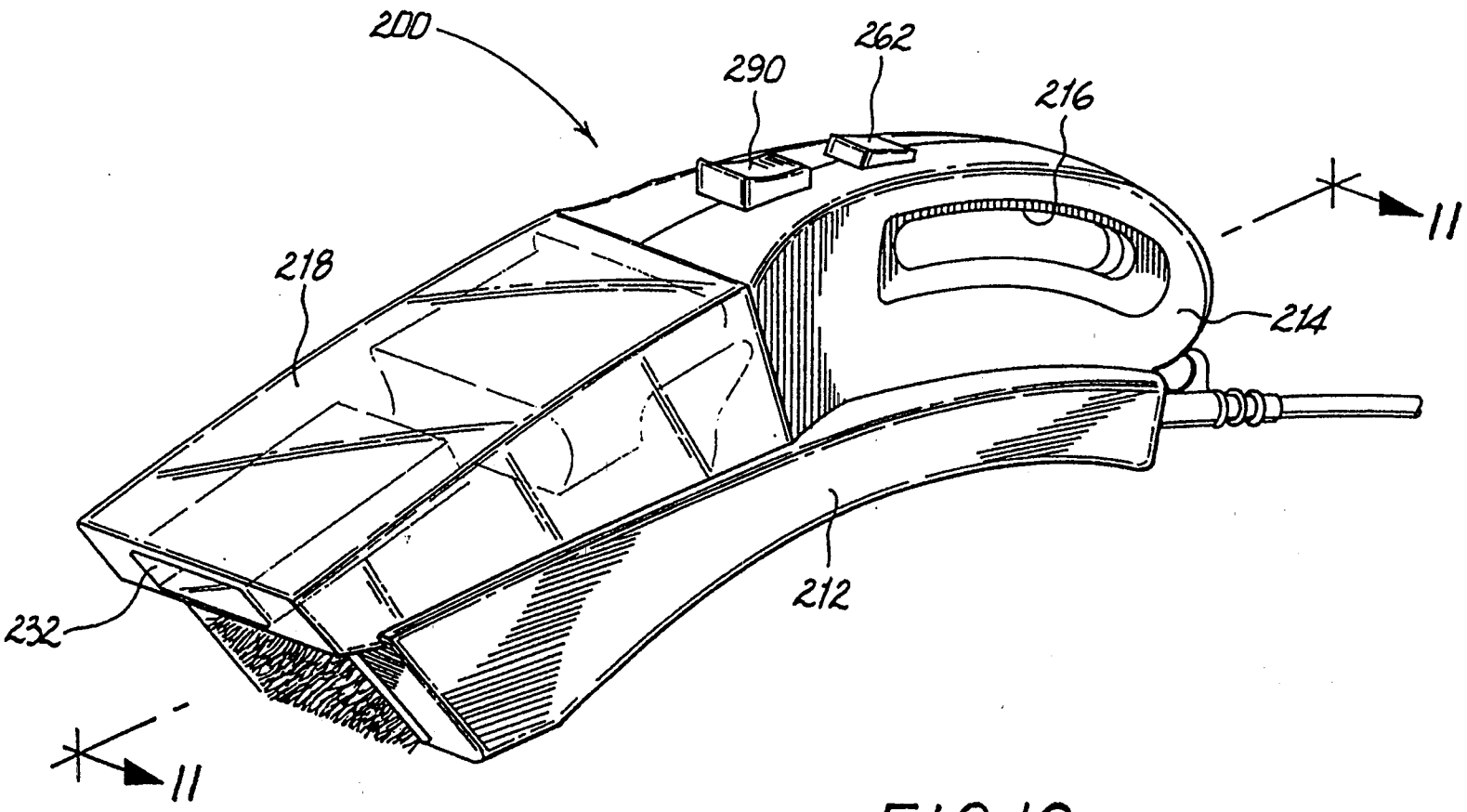
FIG. 10 is a perspective view of another embodiment of the portable steam vacuum cleaner in accordance with the subject invention.
Figure 11:
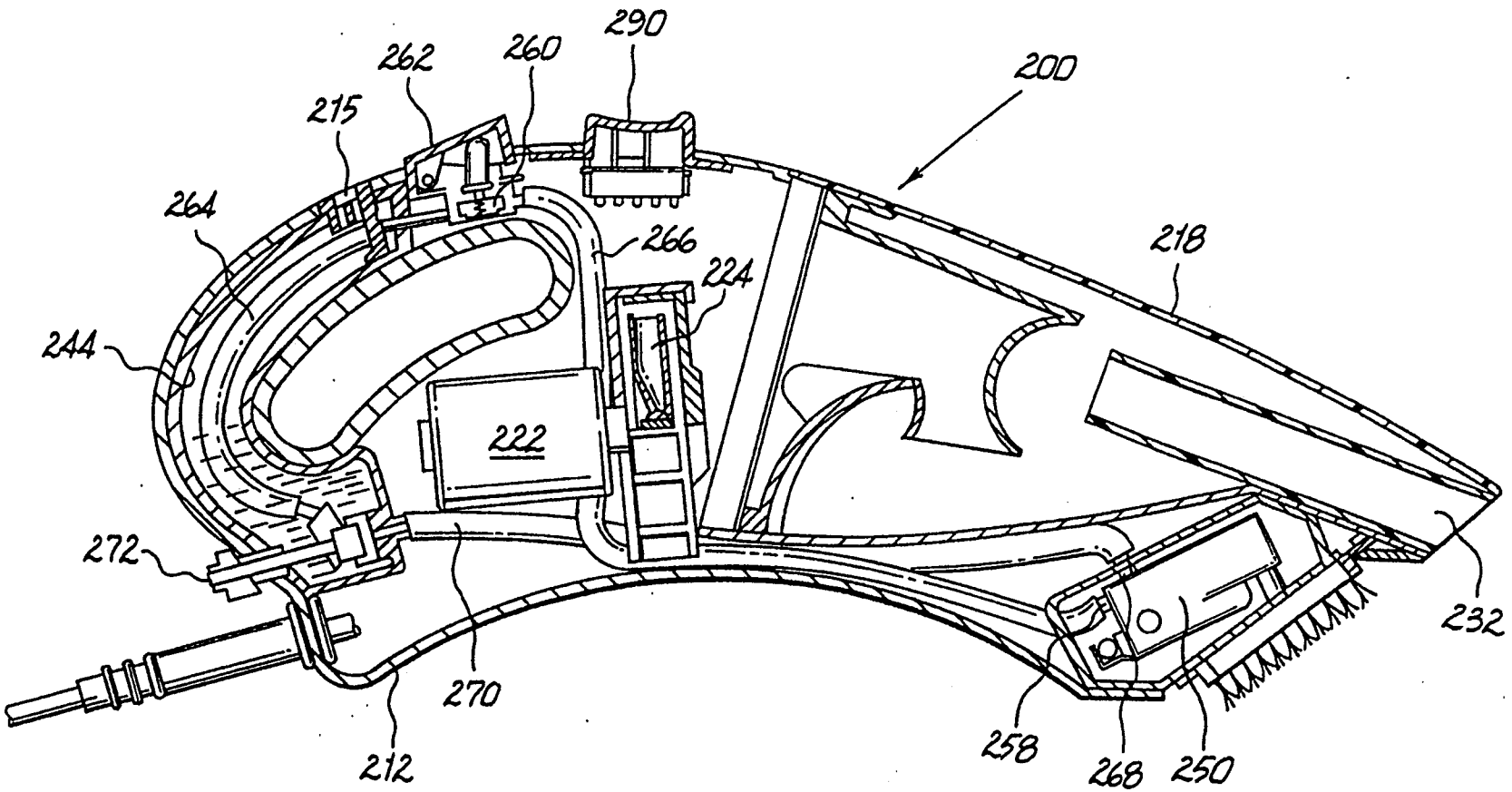
FIG. 11 is a side cross-sectional view taken along line 11—11 of FIG. 10.

Turning to FIGS. 10 and 11, another embodiment of the portable steam vacuum cleaner in accordance with the subject invention is illustrated and designated generally by reference numeral 200. Vacuum cleaner 200 comprises a housing 212 having a handle portion 2 14 defining a handle grip 216, and a nozzle portion 218. A motor 222 and fan 224 are enclosed within housing 212 for creating a vacuum to draw debris and liquid into the nozzle portion 218 through an uptake port 232. A reservoir 244 is defined in the handle portion 214 of vacuum cleaner 200 which may be filled with water or cleaning solution through an aperture 215 extending through the wall thereof.

A pump 260 is provided in vacuum cleaner 200 operable by a toggle switch 262 for pumping liquid from reservoir 244 to a heating unit 250. A delivery tube 264 extends from the reservoir 244 to pump 260, and an outlet tube 266 extends from pump 260 through housing 212 to an entrance port 258. A relief valve 268 may be provided for returning liquid to reservoir 244 from heating unit 250 via a tubular conduit 270 in the event of overpressurization. Valve 268 is provided in the cover panel 254 of heating unit 250. An external relief valve 272 is associated with tubular conduit 270 for releasing pressure outside the vacuum 200.

In operation, vacuum cleaner 200 is prepared for use by heating the unit 250 for a sufficient period of time, and thereupon depressing the toggle switch 262 so that pump 260 delivers liquid to heating unit 250 where it is sufficiently heated to generate pressurized steam for delivery to an area to be cleaned. Thereafter, the motor driven fan 224 is activated by depressing switch 290 to draw excess liquid and debris into the nozzle portion 218 of vacuum cleaner 200.

Figure 12:
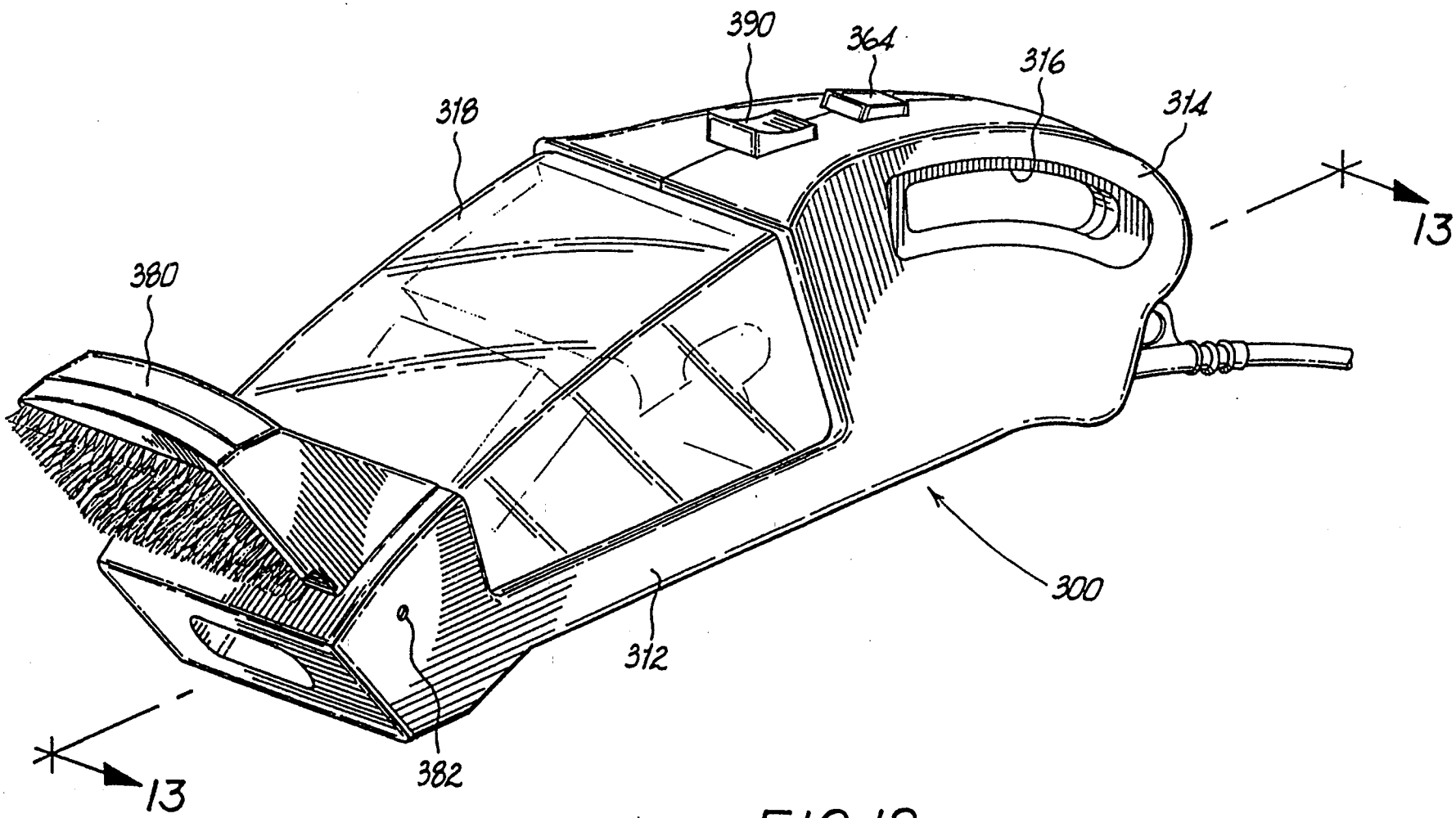
FIG. 12 is a perspective view of yet another embodiment of the portable steam vacuum cleaner in accordance with the subject invention.
Figure 13:
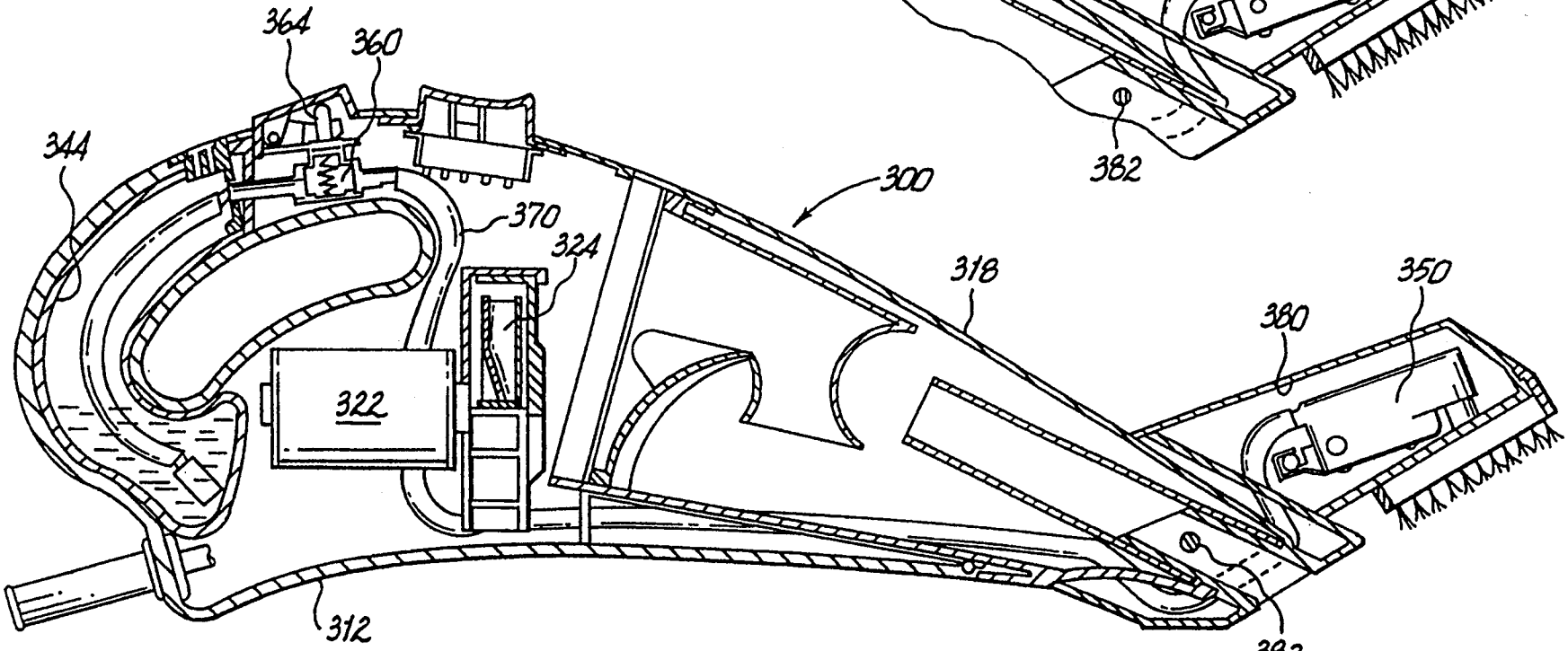
FIG. 13 is a side cross-sectional view taken along line 13—13 of FIG. 12.

Referring to FIGS. 12 and 13, yet another embodiment of the portable steam vacuum cleaner of the subject invention is illustrated and is designated generally by reference numeral 300. Vacuum cleaner 300 is substantially similar to vacuum cleaner 200 in that it comprises a pump 360 operable by a toggle switch 364 for transferring liquid from a reservoir 344 defined in a handle portion 314 to a heating unit 350 via a tubular conduit 370 extending through the housing portion 312 thereof. Vacuum cleaner 300 differs however, in that the heating unit 350 is enclosed within a chamber 380 which is pivotably mounted with respect to the housing 312 thereof by a pivot pin 382. By mounting the heating unit 350 in this manner, the range of operability of vacuum cleaner 300 is substantially increased.

Figure 14:
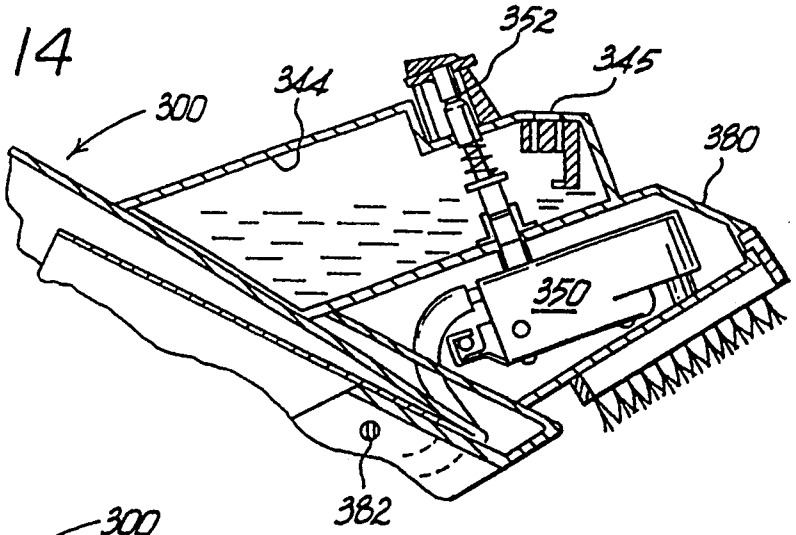
FIG. 14 is a cross-sectional view of an alternate embodiment of the portable steam vacuum cleaner of FIG. 13.

Referring to FIG. 14, an alternate embodiment of vacuum cleaner 300 is illustrated wherein the reservoir 344 is positioned adjacent heating unit 350 enclosed within chamber 380 and adapted to be filled through an aperture 345 associated therewith. Arranged in this manner, a pump is not required for transferring the liquid from the reservoir to the heating unit. Instead, a conduit 348 extends from the reservoir 344 to heating unit 350 and includes a manually operated control valve 352 for selectively controlling the flow of liquid to heating unit 350.

In use, cleaning solution or water is delivered from reservoir 344 to the heating unit 350 by depressing the control valve 352 to allow liquid to gravitate into heating unit 350 where it is generated into pressurized steam for delivery to an area to be cleaned.

Figure 15:
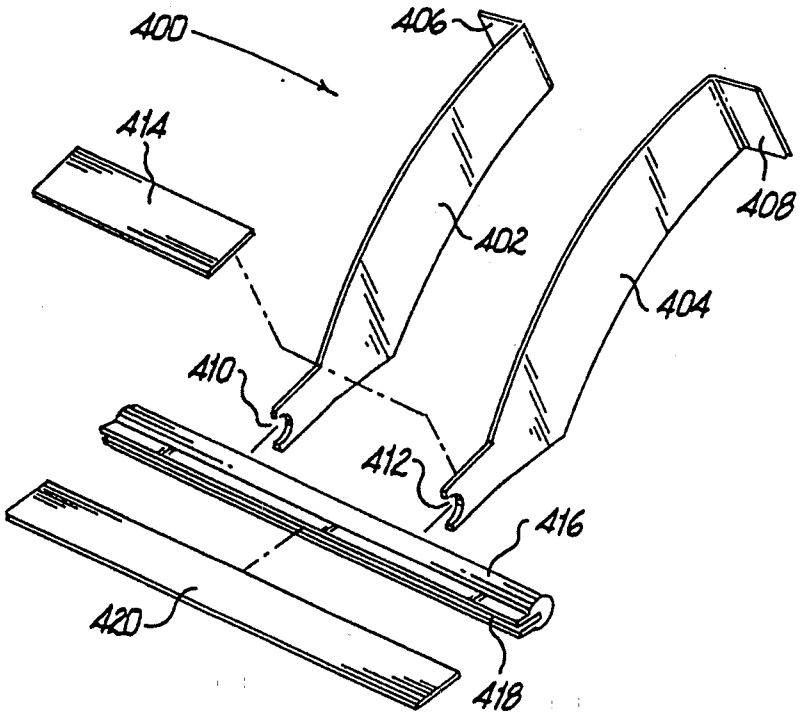
FIG. 15 is an exploded perspective view of a squeegee assembly in accordance with a preferred embodiment of the subject invention.

Turning now to FIG. 15, there is illustrated a squeegee assembly designated generally by reference numeral 400 and configured to be mounted adjacent the nozzle portion of vacuum cleaner 10 which is described hereinabove and illustrated in FIGS. 1—4.

Figure 16:
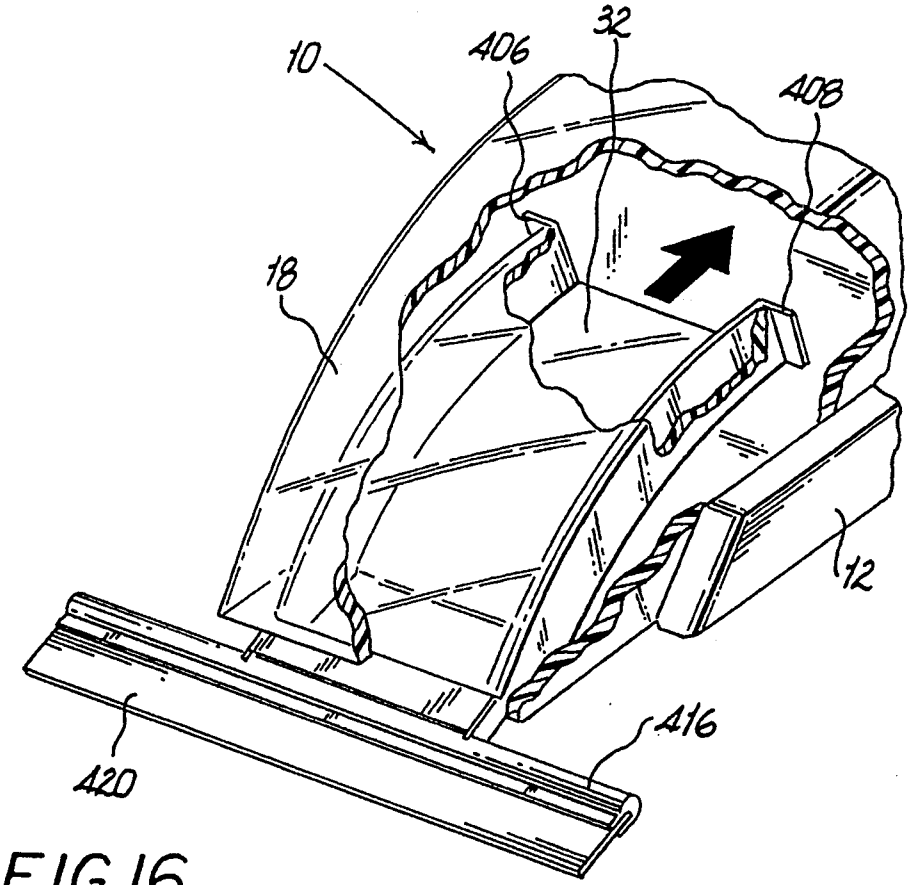
FIG. 16 is a perspective view in partial cross-section of the vacuum cleaning apparatus of FIG. 1 in conjunction with the squeegee assembly of FIG. 15.

More particularly, as best seen in FIG. 16, squeegee assembly 400 is adapted to detachably mount within uptake port 32 of the nozzle portion 18 of vacuum cleaner 10. Squeegee assembly 400 comprises a pair of mounting brackets 402 and 404 each having an outwardly extending rear flange 406 and 408, respectively, and a respective forward engaging fork 410 and 412. The rear flanges 406 and 408 are configured to engage the side walls of uptake port 32 at the trailing end thereof. A bridge member 414 rigidly connects the forward portions of brackets 402 and 404 and permits the relative inward flexure of the rear portion thereof to facilitate the unobstructed insertion of the brackets 402 and 404 into uptake port 32 for mounting the squeegee assembly 400.

Squeegee assembly 400 further comprises a blade retention member 416 dimensioned and configured to be received within the forward engaging forks 410 and 412 of mounting brackets 402 and 404. Retention member 416 includes an elongated engagement slot 418 for releasably retaining a replaceable squeegee blade 420. The squeegee blade 420 is preferably formed from a strip of material, such as, for example, rubber or a similar flexible material.

Figure 18:
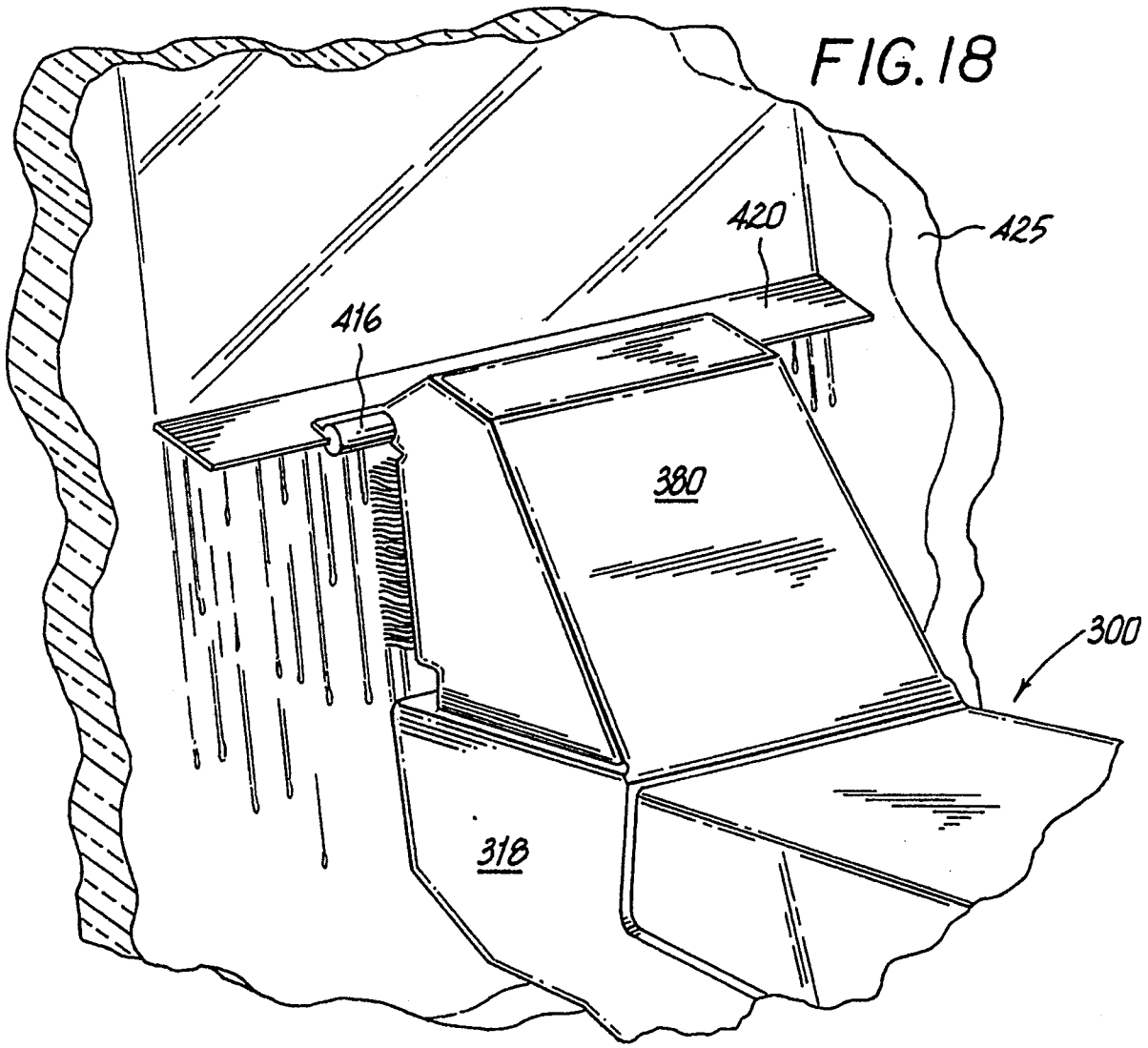
FIG. 18 is a perspective view of the vacuum cleaning apparatus of FIG. 17 during a cleaning operation.
Figure 17:
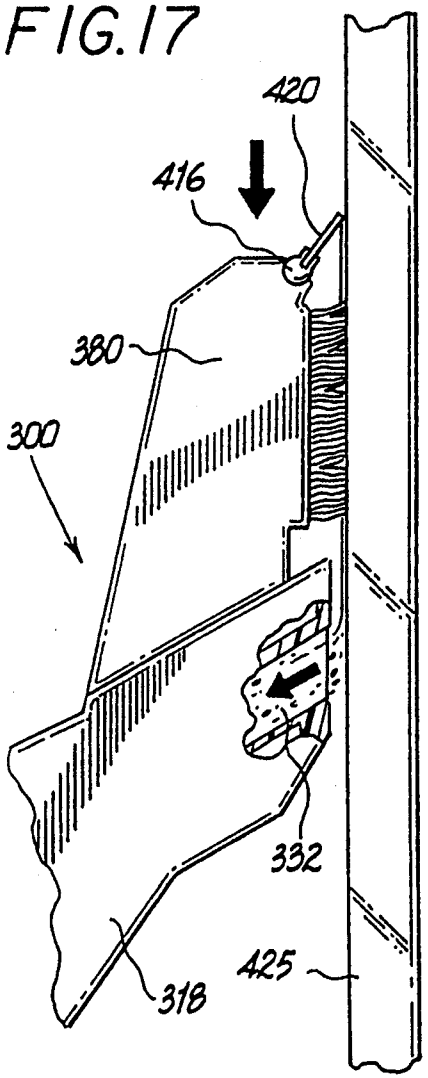
FIG. 17 is a side elevational view of the vacuum cleaning apparatus of FIG. 12 in conjunction with the squeegee assembly of FIG. 15.

Referring to FIGS. 17 and 18, an alternative embodiment of the squeegee assembly of the subject invention is illustrated in conjunction with vacuum cleaner 300 which is described hereinabove and illustrated in FIGS. 12—14. In this embodiment of the window cleaning apparatus, the blade retention member 416 is mounted adjacent the scrubbing brush provided on chamber 380. Member 416 may be detachably mounted to vacuum cleaner 300, or alternatively, may be integrally constructed with vacuum cleaner 300. In operation, steam generated by the heating unit 350 disposed within chamber 380 is delivered to a surface to be cleaned such as window 425 as described in detail hereinabove with respect to vacuum cleaner 300. Shortly thereafter, utilizing squeegee blade 420, the operator wipes the steamed window 425 in a continuous downward stroke. As liquid is wiped from the window 425 by squeegee blade 420, it is drawn into the uptake port 332 of nozzle portion 318 and transferred into the liquid containing area formed therein.

To the extent not already indicated, it also will be understood by those of ordinary skill in the art to which the subject invention appertains that any one of the various specific embodiments herein described and illustrated may be further modified to incorporate features shown in other of the specific embodiments. For example, the vacuum cleaner may be utilized to steam clean large surfaces by directing the deposited liquid towards the vacuum uptake port, or to vacuum large spills by gathering the spill with the squeegee blade while collecting the spill with the vacuum.

Although the subject invention has been shown and described with respect to a preferred embodiment, it will be understood by those skilled in the art that various modifications and changes may be made therein without departing from the spirit and scope of the invention as defined by the appended claims.

What is claimed is:

1. An apparatus for cleaning flat surfaces comprising:
a) a housing having a handle portion and a nozzle portion;
b) means for scrubbing said flat surface mounted on said housing adjacent said nozzle portion;
c) a squeegee assembly mounted to said housing adjacent said nozzle portion for wiping a flat surface; and
d) collection means for drawing liquid from the surface into said nozzle portion.

2. An apparatus as recited in claim 1, further comprising a reservoir defined in said housing for retaining clean liquid, and means for heating the clean liquid so as to generate steam for delivery to the flat surface.

3. An apparatus as recited in claim 2, further comprising means for transferring the clean liquid from said reservoir to said heating means.

4. An apparatus as recited in claim 1, wherein said collection means comprises a motor driven fan assembly disposed in said housing and communicating with said nozzle portion.

5. An apparatus as recited in claim 4, wherein said collection means further comprises means for containing the liquid drawn from the flat surface.

6. An apparatus as recited in claim 1, wherein said squeegee assembly is removably mounted adjacent said nozzle portion.

7. An apparatus as recited in claim 6, wherein said squeegee assembly includes a replaceable squeegee blade formed of a flexible material.

8. An apparatus for cleaning flat surfaces comprising:
a) a housing having a handle portion and a nozzle portion;
b) a reservoir defined in said housing for retaining clean liquid for delivery to a flat surface;
c) means for delivering the liquid as steam to the surface to be cleaned;
d) means for scrubbing the Surface to be cleaned mounted on said housing adjacent said nozzle portion;
e) a squeegee assembly mounted to said housing adjacent said nozzle portion for wiping the surface; and
f) collection means for drawing unclean liquid from the surface into said nozzle portion.

9. An apparatus as recited in claim 8, wherein said delivering means includes a heater for heating the clean liquid so as to generate steam for delivery to the surface.

10. An apparatus as recited in claim 9, further comprising means for transferring the clean liquid from said reservoir to said heating means.

11. An apparatus as recited in claim 8, wherein said collection means comprises a motor driven fan assembly disposed in said housing and communicating with said nozzle portion.

12. An apparatus as recited in claim 11, wherein said collection means further comprises means for containing the unclean liquid drawn from the surface.

13. An apparatus as recited in claim 8, wherein said squeegee assembly is removably mounted adjacent said nozzle portion.

14. An apparatus as recited in claim 13, wherein said squeegee assembly includes a replaceable squeegee blade formed of a flexible material.

15. A portable apparatus for steam cleaning flat surfaces comprising:
a) a housing having a handle portion and a nozzle portion;
b) a reservoir defined in said housing for retaining clean liquid;
c) means for heating the clean liquid so as to generate steam for delivery to the surface to be cleaned;
d) a squeegee assembly mounted to said housing adjacent said nozzle portion for wiping the surface; and
e) collection means for drawing unclean liquid from the surface into said nozzle portion.

16. An apparatus as recited in claim 15, wherein said collection means further comprises means for containing the unclean liquid drawn from the surface.

17. An apparatus as recited in claim 15, further comprising valve means for selectively allowing or preventing transferral of the clean liquid from said reservoir to said heating means.

18. An apparatus as recited in claim 15, further comprising means for pumping clean liquid from said reservoir to said heating means.

19. An apparatus as recited in claim 15, wherein said squeegee assembly is detachably mounted adjacent said nozzle portion and includes a replaceable squeegee blade formed from a strip of rubber.

20. An apparatus as recited in claim 15, wherein said heating means comprises an enclosure defining an entry port for receiving clean liquid from said reservoir, a plurality of cascading steam generating chambers in communication with said entry port, and at least one exit port in communication with at least one of said steam generating chambers for releasing steam from said enclosure.

21. An apparatus as recited in claim 20, wherein said heating means further comprises a heating coil in association with said enclosure for transferring heat to said plurality of steam generating chambers.

22. An apparatus as recited in claim 1, wherein said scrubbing means comprises a brush member.

23. An apparatus as recited in claim 8, wherein said scrubbing means comprises a brush member.

24. An apparatus as recited in claim 23, wherein said delivering means delivers liquid to said surface to be cleaned through said brush member.

* * * * *